US006321574B1

(12) United States Patent
Marker et al.

(10) Patent No.: US 6,321,574 B1
(45) Date of Patent: Nov. 27, 2001

(54) DOUBLE KNIT TERRY FABRIC WITH SCULPTURAL DESIGN

(75) Inventors: Ulrich Marker; Fred E. Hunneke, both of Kinston, NC (US)

(73) Assignee: Domestic Fabrics Corporation, Kinston, NC (US)

( * ) Notice: Subject to any disclaimer, the term of this patent is extended or adjusted under 35 U.S.C. 154(b) by 0 days.

(21) Appl. No.: 09/772,007

(22) Filed: Jan. 29, 2001

(51) Int. Cl.[7] ..... D04B 9/12
(52) U.S. Cl. ..... 66/19; 66/194
(58) Field of Search ..... 66/8, 9 R, 19, 66/22, 23, 191, 194, 111, 92, 93

(56) References Cited

U.S. PATENT DOCUMENTS

| | | | | |
|---|---|---|---|---|
| 2,241,901 | * | 5/1941 | Davis | 66/172 |
| 3,631,690 | * | 1/1972 | Findlay et al. | 66/111 |
| 3,834,190 | * | 9/1974 | Kuhn | 66/111 |
| 3,990,268 | * | 11/1976 | Smith | 66/92 |
| 4,043,151 | * | 8/1977 | Schmidt | 66/194 |
| 4,702,091 | * | 10/1987 | Good et al. | 66/171 |
| 4,726,400 | | 2/1988 | Heiman | 139/396 |
| 4,843,653 | * | 7/1989 | Coble | 66/170 |
| 5,186,025 | * | 2/1993 | Neher | 66/194 |
| 5,823,012 | * | 10/1998 | Hacskkaylo | 66/171 |
| 6,199,409 | * | 3/2001 | Shibata | 66/25 |

* cited by examiner

*Primary Examiner*—Danny Worrell
(74) *Attorney, Agent, or Firm*—Coats & Bennett, P.L.L.C.

(57) ABSTRACT

A multi-color, knitted, sculpted, terry fabric is formed with two yarns on a circular double knitting machine having cylinder and dial needles by forming a ground layer by actuating the dial needles to engage both yarns, and by selectively actuating the cylinder needles to engage one or both yarns to form pile loops, or neither yarn to form no pile loops. The cylinder needles are opened upon actuation by operation of a latch opening mechanism that is moveable and biased towards an engaging position. The fabric may be held down as the cylinder needles actuate by a hold down bar. Multi-color, three-dimensional, non-repeating patterns may be formed in the fabric by using yarns of different color, and by selectively forming regions having no pile, pile loops of the first yarn, pile loops of the second yarn, and/or pile loops of both yarns.

14 Claims, 8 Drawing Sheets

DOUBLE KNIT TERRY FABRIC WITH SCULPTURAL DESIGN

FIELD OF THE INVENTION

The present inventions relates generally to the field of knitted fabrics and methods for constructing knitted fabrics. More particularly, the present invention relates to a multi-colored, sculpted, knitted terry fabric and a method for making the same.

BACKGROUND OF THE INVENTION

Ornamental terry knit fabrics are known in the art. In general, ornamental terry knit fabrics use pile yarns of different colors to form patterns or designs in the fabric. Patterns or designs are formed by alternately making loops with one pile yarn and then another. Ornamentation for terry knit fabrics has been limited, in the past, to relatively simple striped or checked patterns or relatively simple repeating patterns.

Accordingly, there is a need for a new method for producing terry knit fabrics that can be used to produce complex, non-repeating designs.

SUMMARY OF THE INVENTION

The present invention relates to a method of forming sculpted designs in a terry fabric using a circular double knitting machine having cylinder and dial needles. A ground layer is formed with at least first and second sets of yarns by the dial needles. A plurality of pile loops, that collectively form a sculpted design, are formed in the fabric by selectively actuating the cylinder needles to selectively engage the first and second yarns to form the pile loops during the knitting process. Latches on the cylinder needles are opened by engaging the latches with a latch opener, to enable the cylinder needles to engage the yarns. The latch opener is moveable between an engaged and nonengaged position, and is biased toward the engaged position. A hold down bar may be used to hold the fabric down as the cylinder needles are actuated.

By selectively actuating the cylinder needles, regions in the knitted sculpted terry fabric may be formed having no pile loops, pile loops formed from the first yarn, pile loops formed from the second yarn, and/or pile loops formed from both the first and second yarns. The yarns may be different colors. The cylinder needles may be selectively actuated under the control of a programmable controller, and the design created by the various regions of pile loops may be nonrepeating.

DESCRIPTION OF THE PREFERRED EMBODIMENT

Figure 1:
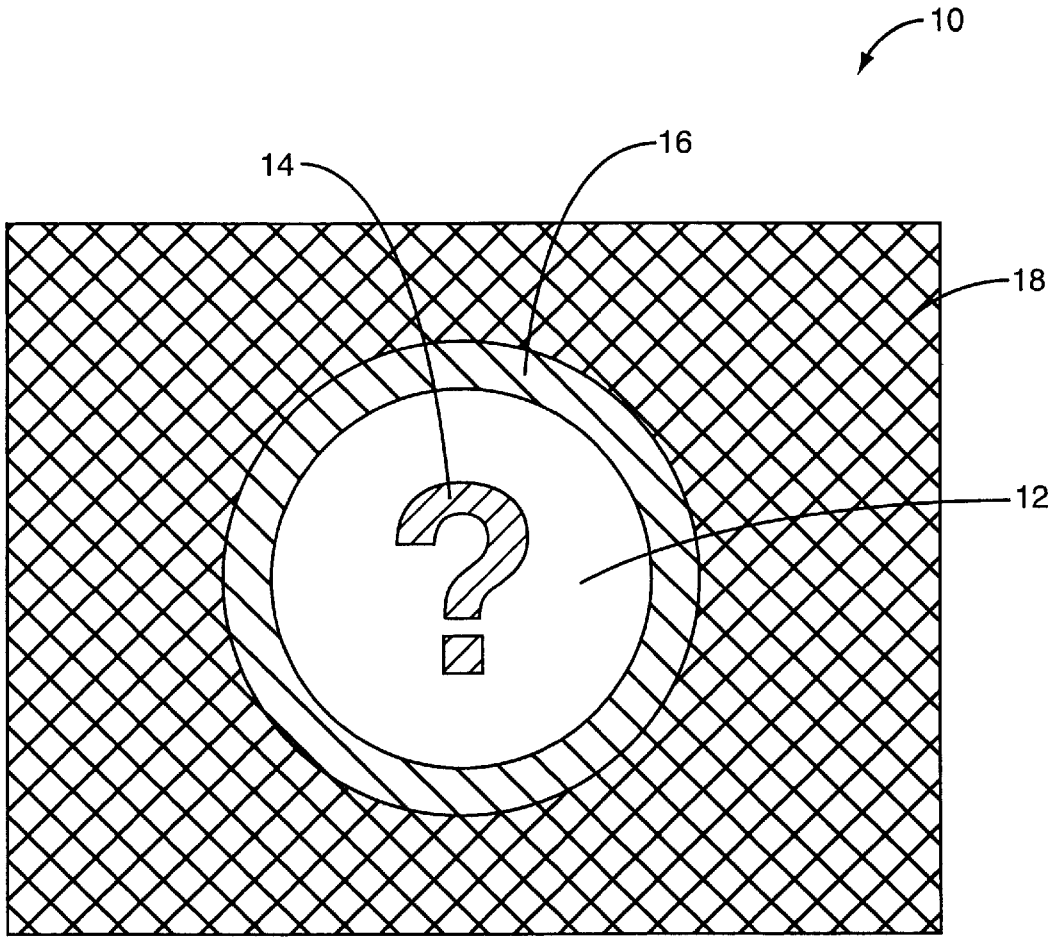
FIG. 1 is a plan view of the sculpted terry fabric of the present invention.

Referring now to the drawings, and particularly to FIG. 1, the sculpted terry fabric 10 of the present invention is shown therein and indicated generally by the numeral 10. In the disclosed embodiment, the sculpted terry fabric has four distinct regions. These regions are defined by the presence and color of pile loops formed in the sculpted terry fabric 10. A ground layer, or area of no pile loops, is indicated by the numeral 12. A pile of terry loops formed from one color of yarn is depicted at 14. A pile of terry loops formed from a second color of yarn is indicated at 16. Finally, a pile comprising both the first and second color yarns is shown, at 18.

Figure 2:
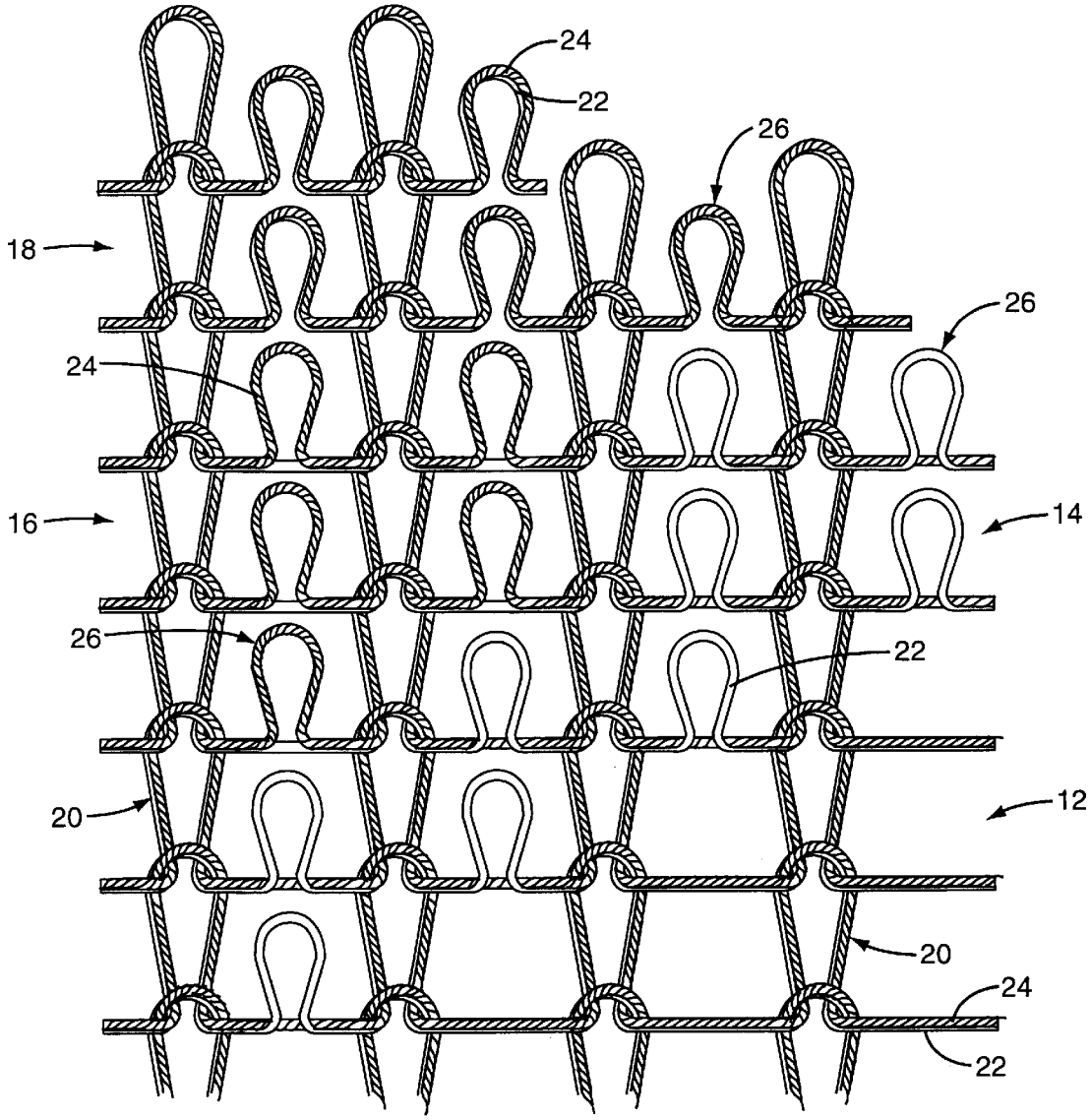
FIG. 2 is a close up of the sculpted terry fabric showing the construction of the fabric.

The sculpted terry fabric 10, as shown overall in FIG. 1 and in detail in FIG. 2, comprises a ground layer 12 and a plurality of terry loops 20 intertwined with the ground layer 12. The ground layer 12 is a conventional jersey knit construction made using two yarns 22 and 24, preferably of different colors. Yarns 22 and 24 may be a made of any natural or synthetic fibers, or a combination thereof. The yarns 24 are depicted as shaded to distinguish them from the yarns 22.

The sculpted terry fabric 10 of the present invention is produced on a conventional circular knitting machine 50 (FIGS. 5 and 6) having cylinder needles 32 and dial needles 34 (FIGS. 3 and 4), commonly referred to as a double knit machine. The dial needles 34 are used to form the ground layer of the sculpted terry fabric while the cylinder needles 32 are selectively actuated to form the pile loops 26. Alternatively, the cylinder needles 32 could form the ground layer 12 and the dial needles 34 could form the pile loops 26. The knitting process will be described more fully below.

FIG. 2 illustrates the four sections of the sculpted terry fabric 10 shown in FIG. 1. The ground layer 12 comprises a plurality of integral loops 20 extending in courses and wales across the sculpted terry fabric 10 to form a plain, single-knit jersey construction. The loops 20 are formed by the dial needles 34 using both sets of yarn 22, 24 as shown in FIG. 2. Pile loops 26 are also formed using yarns 22, 24. Patterns or designs are formed by selectively forming the pile loops 26 with yarns 22, 24. Note that in area 14 pile loops 26 are formed with yarn 22, while in area 16 pile loops 26 are formed with yarn 24. Additionally, it is possible to simultaneously form pile loops 26 with both yarns 22, 24, creating area 18. Area 12 of the fabric does not have pile loops 26, giving the fabric a three-dimensional design.

Figure 3A:
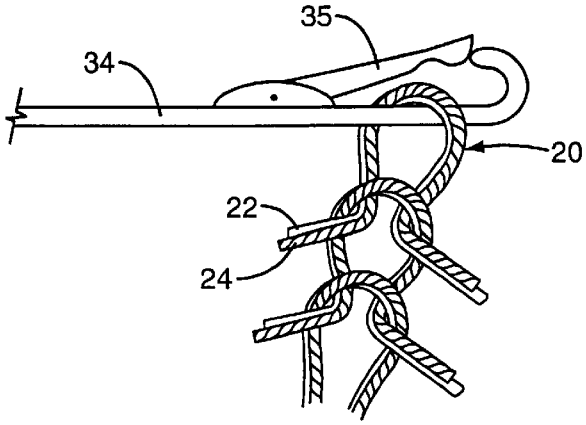
FIG. 3A–3C are schematic drawings showing the knitting process used to make terry fabric.
Figure 3B:
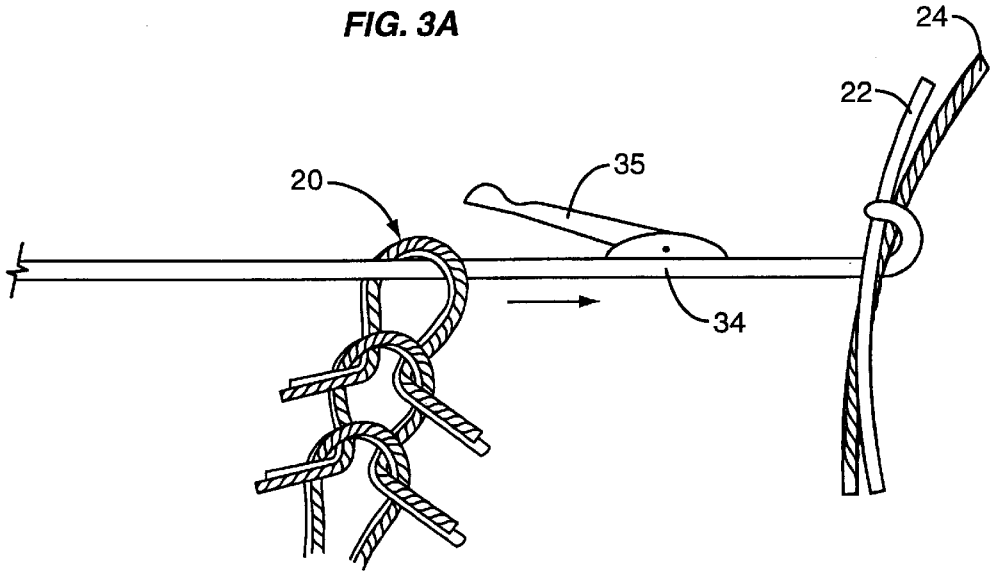
Figure 3C:
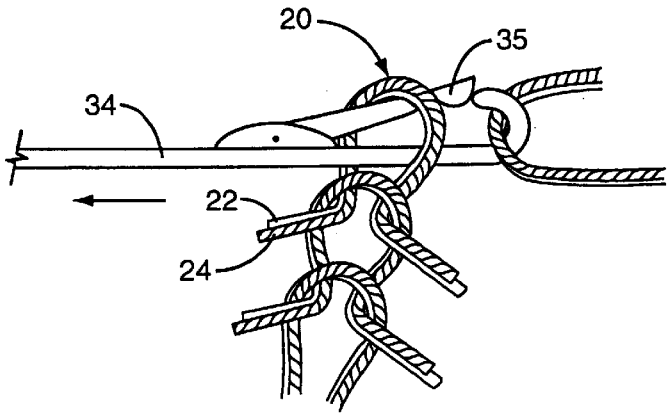

FIG. 3A–3C illustrate how the fabric of FIGS. 1 and 2 is constructed. In FIG. 3A, the dial needle 34 is in the retracted position and the last formed loop 20 is in the latch. The dial needle 34 moves forward to the extended position, as shown in FIG. 3B. While the dial needle 34 is extending, latch 35 is opened by the yarn of loop 20. Yarn 22, 24 are fed to the dial needle 34 while the dial needle 34 is in the extended position and the latch 35 is open. After the yarn 22, 24 is fed to the hook of the dial needle 34, the dial needle 34 retracts, as shown in FIG. 3C, so that the yarns 22, 24 in the hook are pulled through the previous loop 20. The previous loop 20 closes the latch 35 as the dial needle 34 retracts. When the dial needle 34 reaches its retracted position, as shown in FIG. 3A, a new loop 20 is formed and the process is repeated to form the next loop 20.

The cylinder needles 32 are not involved in the knitting of the ground layer 12. While the ground layer is being formed, the cylinder needles 32 may be selectively actuated to form the pile loops 26 of the terry fabric. To form the pile loops 26, the cylinder needles are selectively raised. When the cylinder needle 32 is raised, one or both of the yarns 22 and 24 may be fed through the cylinder needle 32. When the cylinder needle 32 returns to the lowered position, the yarn 22, 24 caught by the cylinder needle 32 forms a pile loop 26. The cylinder needle is then raised to cast off the pile loop without catching the yarns 22 and 24.

Figure 4A:
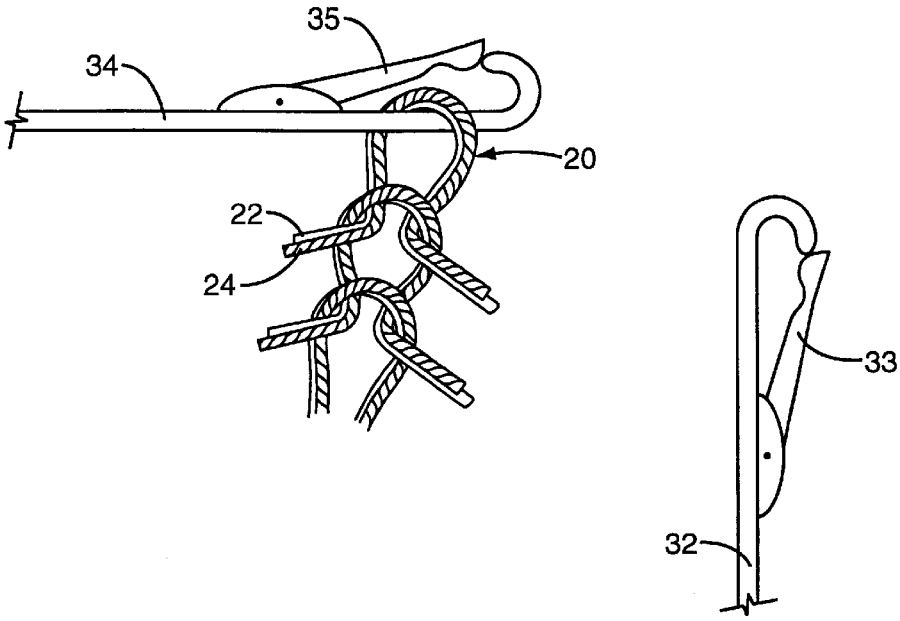
FIGS. 4A–4F are schematic drawings showing the knitting process used to make the sculpted, terry fabric of the present invention.
Figure 4B:
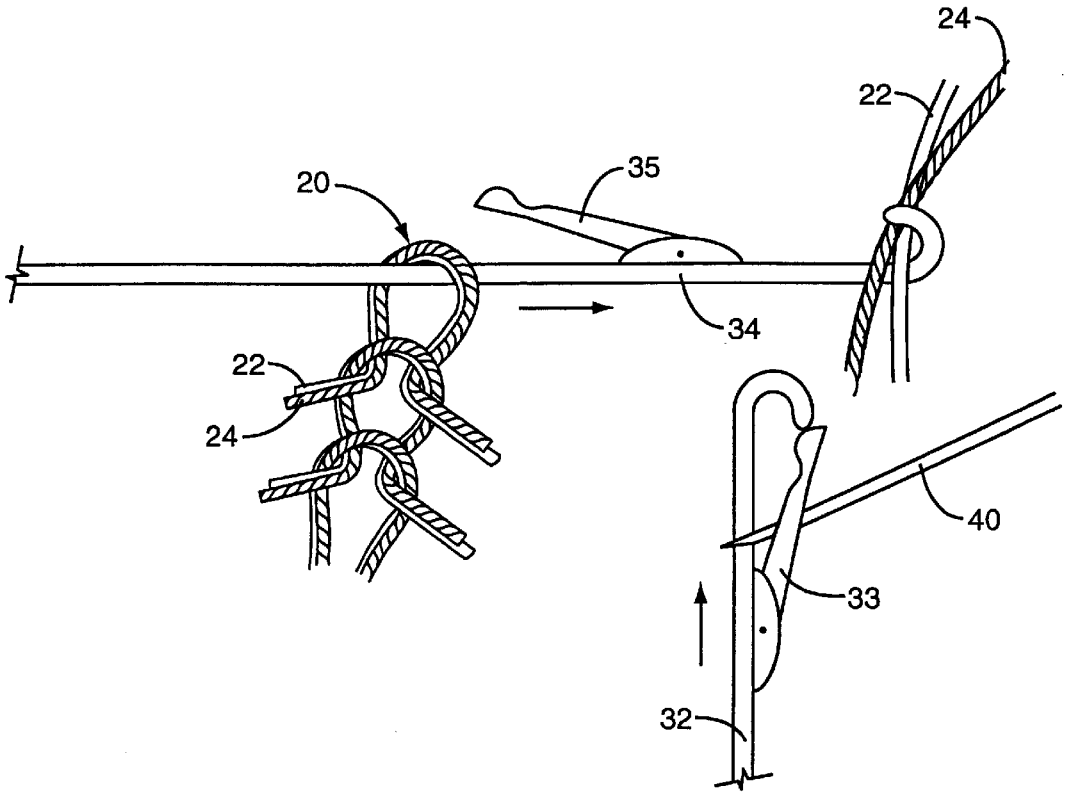
Figure 4C:
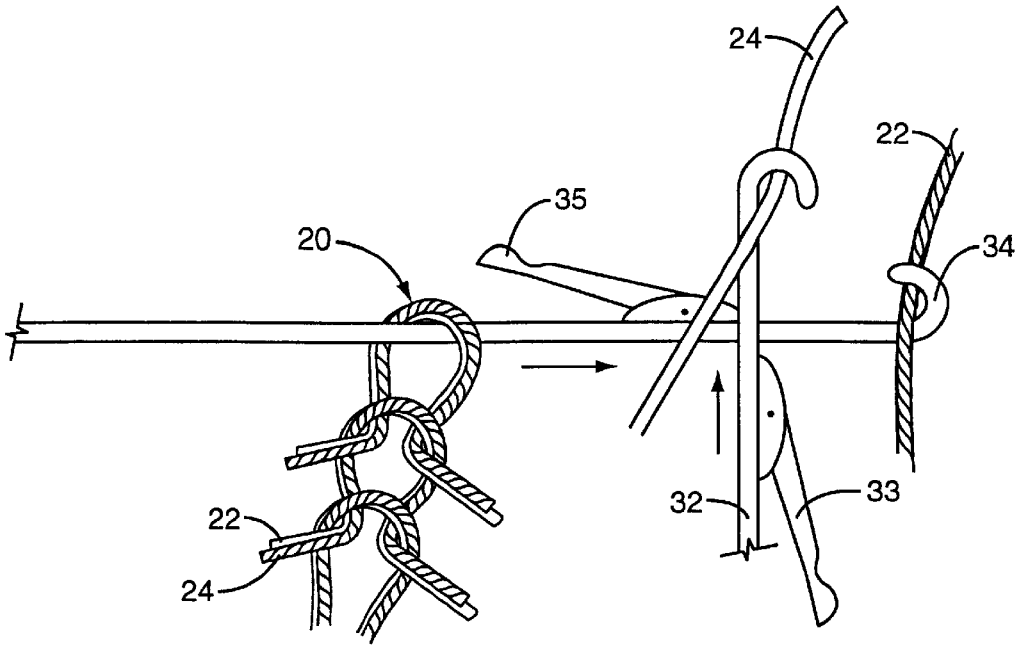
Figure 4D:
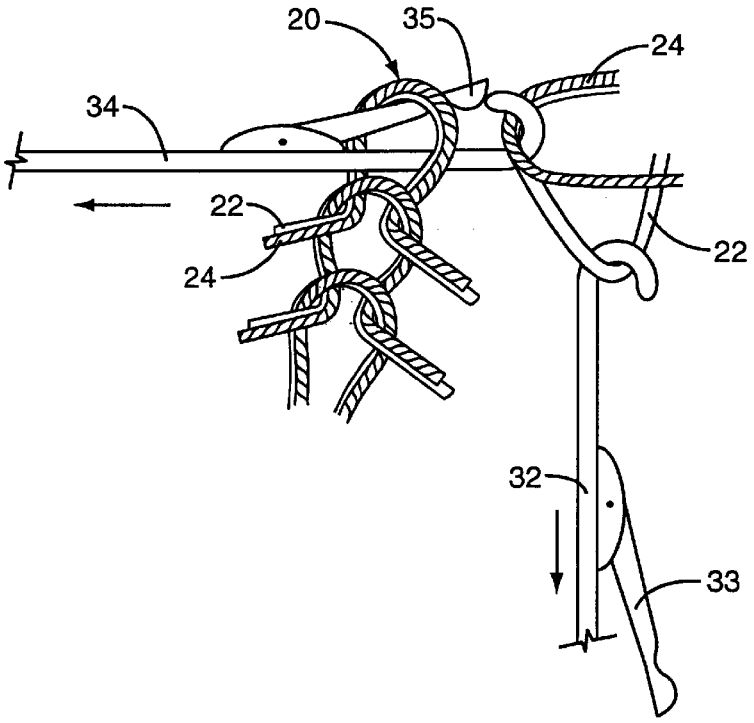
Figure 4E:
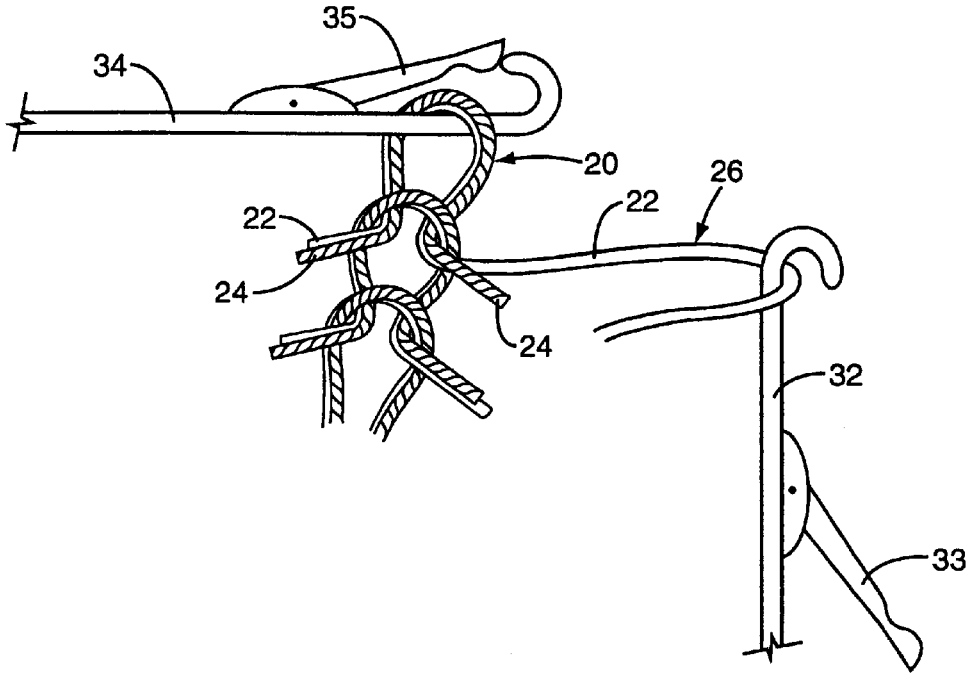
Figure 4F:
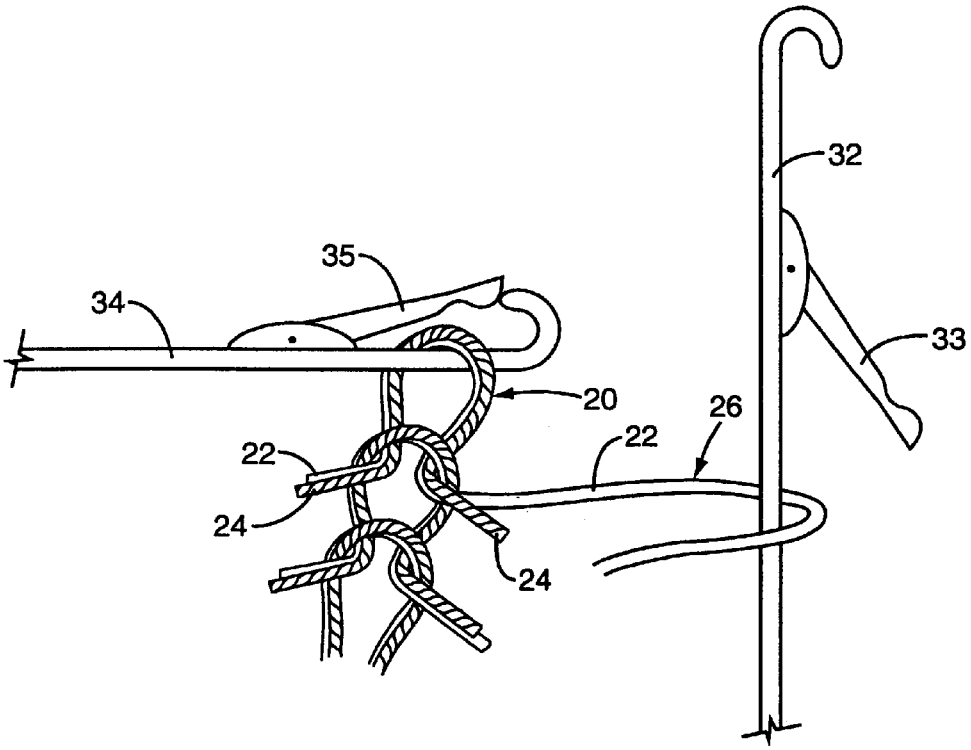

FIGS. 4A–4F illustrate how the pile loops 26 are formed. In FIG. 4A, the previously formed ground layer loop 20 is in the hook of the dial needle 34. The dial needle 34 moves forward to an extended position as shown in FIG. 4B, where the latch 35 is opened by the loop 20, and yarns 22, 24 are fed into the hook of the dial needle 34. At this point, the cylinder needle 32 begins its upward movement from a lowered position to a raised position. The latch 33 of the cylinder needle 32 is initially closed as shown in FIG. 4B. As the cylinder needle 32 moves upward, a latch opener 40 mounted to the knitting machine 50 engages and opens the latch 33 of the cylinder needle 32. The latch opener 40 is described in greater detail below. In FIG. 4C, the cylinder needle 32 is in a raised position. One or both yarns 22, 24 may be fed to the hook of the cylinder needle 32. In FIG. 4C, yarn 24 is fed to the cylinder needle 32. In FIG. 4D, the dial needle 34 is moving to a retracted position and the cylinder needle 32 is moving to a lowered position. Dial needle 34 pulls the yarns 22, 24 through the previously formed ground layer loop 20 to form a new loop 20. At the same time, the cylinder needle 32 is shown pulling yarn 22 down to form a pile loop 26. In FIG. 4E, a new loop 20 has been formed in the ground layer 12 and the pile loop 26 is in the hook of the cylinder needle 32. The cylinder needle 32 moves up as shown in FIG. 4F to cast off the pile loop and then moves back down to the retracted position as shown in FIG. 4A. The process of casting off the pile loop 26 closes the latch 33 on the cylinder needle 32.

Figure 5:
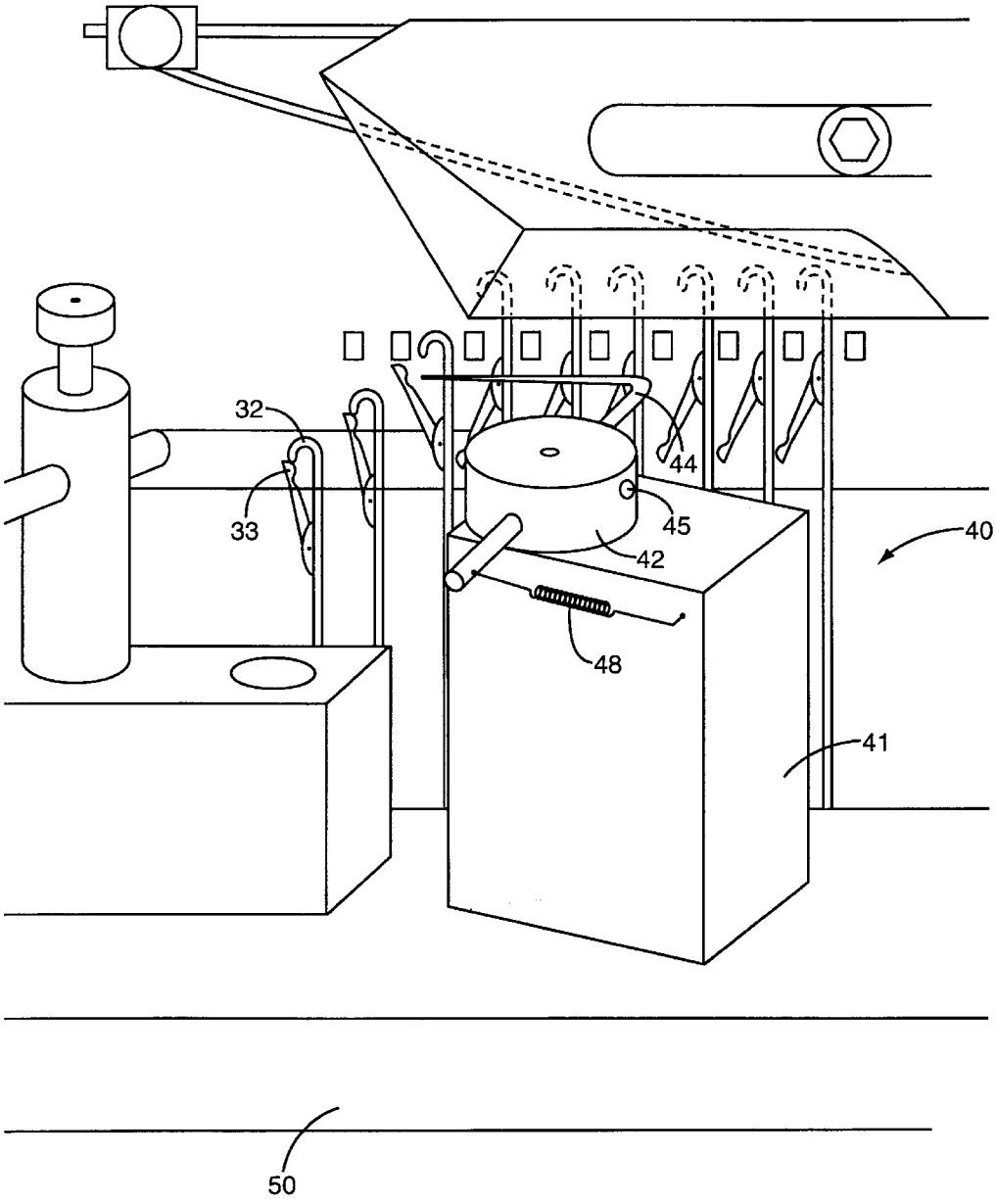
FIG. 5 is a perspective view of a portion of a circular knitting machine showing the latch opener used to open the latches of the cylinder needles.

FIG. 5 is a perspective view showing an exemplary embodiment of the latch opener 40. The latch opener comprises a mounting block 41 that mounts to the cylinder of the knitting machine 50, a turret 42, and a L-shaped rod member 44 with a pointed end. The rod member 44 passes through an opening in the turret 42, which is rotatably mounted to the mounting block 46. A spring 48 is attached to one end of the rod member 44 to bias the latch opener 40 to the position shown in FIG. 5. The rod member 44 is slidably mounted in the turret 42 and held in place by a set screw 45 that allows for adjustment of the rod member 44. In operation, the pointed end of the rod member 44 is positioned as shown in FIG. 5 to engage the latch 33 of the cylinder needle 32 as the cylinder needle 32 move from the lowered position to the raised position. To prevent damage to the cylinder needles 32, the latch opener 40 will pivot out of the way if excessive force is applied to the latch opener 40. Once the force is removed, the spring 48 urges the latch opener back to the position shown in FIG. 5.

Figure 6:
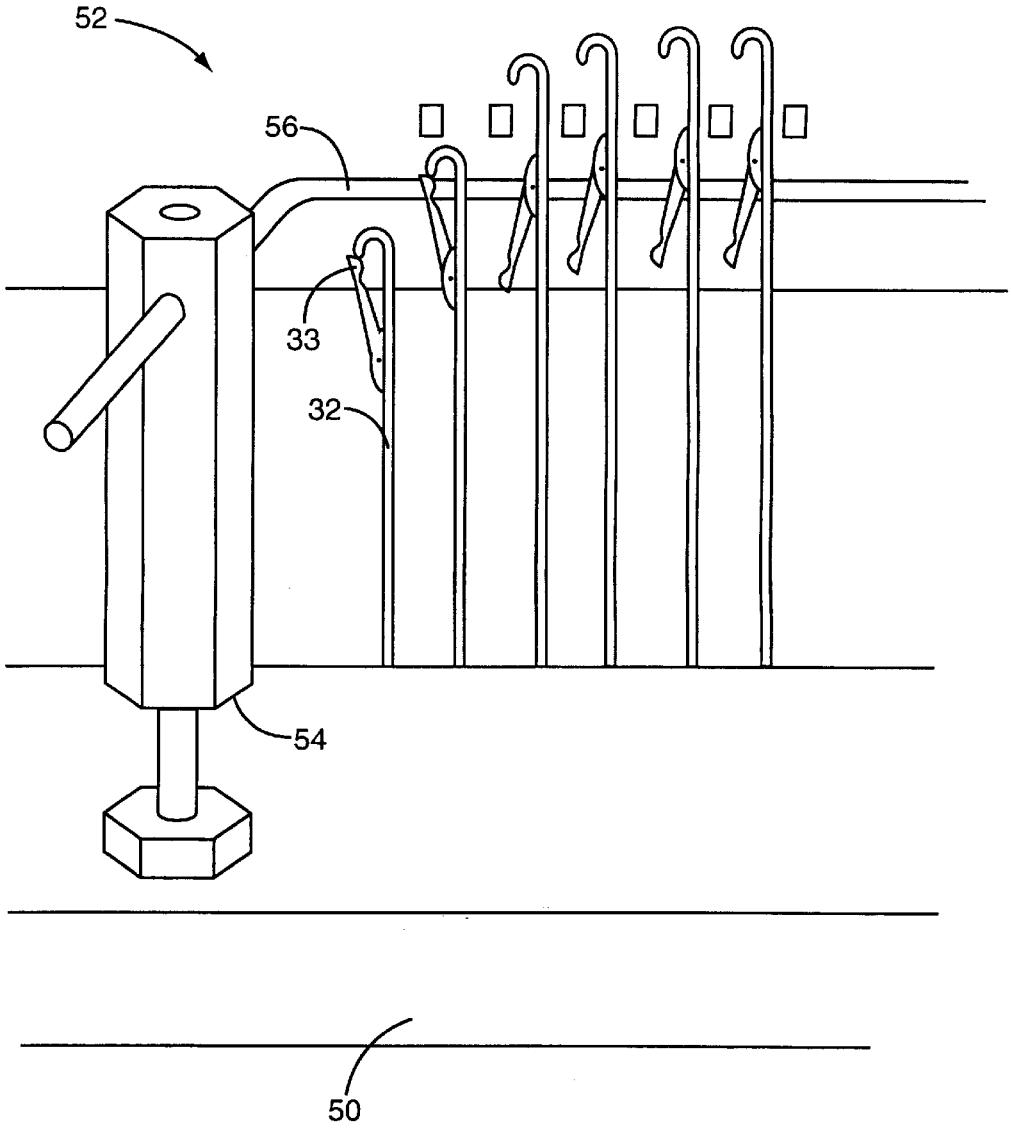
FIG. 6 is a perspective view of a portion of a circular knitting machine showing a hold down bar used to hold down the knitted fabric.

FIG. 6 shows an optional hold-down bar 52. The function of the hold-down bar 52 is to hold the knitted fabric down while the cylinder needles are being raised. The hold-down bar comprises a mounting block 54 which mounts to the cylinder of the knitting machine 50 and an L-shaped bar 56. The L-shaped bar 56 is slidably mounted in the mounting block 54 to allow for some adjustment of the hold-down bar 52. The hold-down bar 52 is positioned in the verge between the cylinder and the dial of the knitting machine 50.

By selectively actuating the cylinder needles 32, it is possible to form an endless number of different sculpted terry fabrics 10. Virtually any two dimensional pattern or design can be formed by selectively engaging the yarns 22 and 24 in the cylinder needle 32 to form pile loops 26 of different colors. Also, a three dimensional or sculpted effect can be created by leaving the cylinder needles 32 in the lowered position to form an area without any pile loops. Thus, a fabric using two different color yarns 22 and 24 may have four distinct regions as shown in FIG. 1. Region 14 has pile loops formed using yarn 22, region 16 has pile loops formed using yarn 24, region 18 has pile loops formed with both yarns 22 and 24 and region 12 has no pile loops.

The type of yarns 22 and 24 used are not a material aspect of the present invention. The yarns 22 and 24 may be of similar type and size, or may be of different types or sizes. For example, the sculpted terry fabric 10 may be made entirely of cotton, poly-cotton or polyester fibers. The preferred yarn size is in the range of 16 to 22 denier. There may be instances where different types or sizes of yarns may be used.

The selective actuation of cylinder needles 32 (or alternatively, of dial needles 34) as described above may be controlled by a controller. The controller may comprise a programmable digital microprocessor, microcontroller, digital signal processor or the like. The controller may additionally be operatively connected to a scanner, camera, or other graphical input means for the acquisition of images and designs. The designs that may be formed in the sculpted terry fabric of the present invention may be non-repeating, and may be of arbitrary complexity. The sculpted terry fabric of the present invention is especially useful for making sweatshirts and the like with team logos or corporate logos formed therein.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the spirit and scope of the invention. The present embodiments are therefore to be construed in all aspects as illustrative and not restrictive and all changes coming within the meaning and equivalency range of the appended claims are intended to be embraced therein.

What is claimed is:

1. A method of forming a knitted sculpted terry fabric on a circular double knitting machine having a set of cylinder needles and a set of dial needles, comprising:

a. forming a ground layer on one of said sets of needles;

b. forming a plurality of pile loops that collectively form a design by actuating the other said set of needles to selectively engage at least one yarn to form said pile loops during the knitting process; and c. opening latches on said other set of needles by engaging the latches with a latch opener to enable said other set of needles to engage said yarns.

2. The method of claim 1, wherein said latch opener is moveable between engaging and non-engaging positions.

3. The method of claim 2 wherein said latch opener is biased toward the engaging position.

4. The method of claim 1 wherein said design formed by said pile loops comprises a non-repeating pattern.

5. The method of claim 1 wherein said circular double knitting machine further comprises a hold down bar, and wherein forming a plurality of pile loops that collectively form a design further comprises holding said knitted sculpted terry fabric down by said hold down bar when selectively actuating said other set of needles.

6. The method of claim 1 wherein the other set of needles selectively engage at least two yarns to form the pile loops.

7. The method of claim 6 wherein the two yarns are of different color.

8. The method of claim 1 wherein said circular double knitting machine further comprises a programmable controller, and wherein said other set of needles are selectively actuated responsive to said controller.

9. The method of claim 1 wherein the act of forming a ground layer on one set of needles includes forming the ground layer on said dial needles and wherein the act of forming a plurality of pile loops includes actuating the set of cylinder needles to selectively engage the yarn to form the pile loops.

10. The method of claim 8 wherein said controller comprises a digital microprocessor.

11. A knitted sculpted terry fabric formed on a circular double knitting machine and having a non-repeating design, comprising:

a. a knitted ground layer comprising an array of ground loops formed by at least one yarn; and b. at least one raised area formed over at least a portion of the ground layer wherein the raised area comprises an array of pile loops formed by at least one yarn.

12. The fabric of claim 11 wherein the pile loops are selectively formed from a first and a second yarn, and wherein the non-repeating design comprises selected portions of said fabric exhibiting a characteristic selected from the group including no pile loops, pile loops of said first yarn, pile loops of said second yarn, and pile loops of both said first and second yarns.

13. The fabric of claim 12 wherein said first and second yarns are of different colors.

14. A knitted sculpted terry fabric formed on a circular double knitting machine having a set of cylinder needles and a set of dial needles, by the process of:

a. forming a ground layer on one of said sets of needles;

b. forming a plurality of pile loops that collectively form a design by selectively actuating the other said set of needles to selectively engage at least one yarn to form said pile loops during the knitting process; and c. opening latches on other set of needles by engaging the latches with a latch opener to enable said cylinder needles to engage said yarns.

* * * * *